US006422697B1

(12) United States Patent
Merkel et al.

(10) Patent No.: US 6,422,697 B1
(45) Date of Patent: Jul. 23, 2002

(54) INK JET PRINTING METHOD

(75) Inventors: Paul B. Merkel, Victor; Patricia A. Wyble, Webster, both of NY (US)

(73) Assignee: Eastman Kodak Company, Rochester, NY (US)

( * ) Notice: Subject to any disclaimer, the term of this patent is extended or adjusted under 35 U.S.C. 154(b) by 52 days.

(21) Appl. No.: 09/610,735

(22) Filed: Jul. 6, 2000

(51) Int. Cl.[7] ..... B41J 2/01

(52) U.S. Cl. ..... 347/105; 347/101; 347/106; 428/195; 428/500

(58) Field of Search ..... 428/195, 500; 347/105, 106, 101

(56) References Cited

U.S. PATENT DOCUMENTS

| | | | | |
|---|---|---|---|---|
| 4,554,181 A | * | 11/1985 | Cousin et al. | 427/261 |
| 5,500,668 A | * | 3/1996 | Malhotra et al. | 347/105 |
| 5,738,932 A | * | 4/1998 | Kondo et al. | 428/195 |
| 6,051,306 A | * | 4/2000 | Paulson | 428/195 |

FOREIGN PATENT DOCUMENTS

| | | | |
|---|---|---|---|
| EP | 0 087 544 | 9/1983 | |
| EP | 0 943 450 | 9/1999 | |
| JP | 59053562 | 3/1984 | |
| JP | 59053565 | 3/1984 | |
| JP | 59053566 | 3/1984 | |
| JP | 59053567 | 3/1984 | |
| JP | 09267546 | * 10/1997 | B41M/5/00 |

* cited by examiner

*Primary Examiner*—Bruce H. Hess
*Assistant Examiner*—Michael E. Grendzynski
(74) *Attorney, Agent, or Firm*—Harold E. Cole

(57) ABSTRACT

An ink jet printing method, comprising the steps of:

A) providing an ink jet printer that is responsive to digital data signals;

B) loading the printer with an ink jet recording element comprising a substrate having thereon an image-receiving layer comprising a heterocyclic amine polymer, the image-receiving layer having associated therewith a water-soluble first-row transition metal ion salt;

C) loading the printer with an ink jet ink composition; and

D) printing on the ink jet recording element using the ink jet ink in response to the digital data signals.

9 Claims, No Drawings

INK JET PRINTING METHOD

CROSS REFERENCE TO RELATED APPLICATIONS

Reference is made to the following commonly assigned, co-pending U.S. patent application Ser. No. 09/610,736 by Merkel, filed concurrently herewith entitled "Ink Jet Recording Element", pending; U.S. patent application Ser. No. 09/611,123 by Merkel, filed concurrently herewith entitled "Ink Jet Printing Method", pending; the disclosures of which are hereby incorporated by reference.

FIELD OF THE INVENTION

This invention relates to an ink jet printing method. More particularly, this invention relates to an ink jet printing method using a recording element containing a polymer and a metal ion salt.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have limited their commercial usefulness.

It is well known that in order to achieve and maintain photographic-quality images on such an image-recording element, an ink jet recording element must:

- Be readily wetted so there is no puddling, i.e., coalescence of adjacent ink dots, which leads to non-uniform density
- Bind dye with sufficient strength to minimize both water washout and high-humidity smearing
- Exhibit no image bleeding
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

EPA 943 450 relates to an ink jet recording sheet containing a water-soluble divalent or greater metallic salt. However, there is no teaching of the advantages provided by first-row transition metal ions nor of their advantageous use with heterocyclic amine polymers.

Use of first-row transition metals in ink compositions for ink jet printers is disclosed in JP 59053562A, JP 59053565A, JP 59053566A, JP 59053567A and EPA 087544. However, there is no disclosure in these references of ink jet receiver elements containing these metal ion salts in combination with heterocyclic amine polymers.

It is an object of this invention to provide an ink jet printing method using a recording element that has good light stability for a dye image transferred to it. It is another object of this invention to provide an ink jet printing method using a recording element that provides good dye binding.

SUMMARY OF THE INVENTION

These and other objects are achieved in accordance with the invention which comprises an ink jet printing method, comprising the steps of:

A) providing an ink jet printer that is responsive to digital data signals;

B) loading the printer with an ink jet recording element comprising a substrate having thereon an image-receiving layer comprising a heterocyclic amine polymer, the image-receiving layer having associated therewith a water-soluble first-row transition metal ion salt;

C) loading the printer with an ink jet ink composition; and

D) printing on the ink jet recording element using the ink jet ink in response to the digital data signals.

Using the ink jet printing method of the invention, an ink jet recording element is obtained which provides good dye binding and improved light stability.

DETAILED DESCRIPTION OF THE INVENTION

The substrate used in the invention may be porous such as paper or nonporous such as resin-coated paper; synthetic paper, such as Teslin® or Tyvek®; an impregnated paper such as Duraform®; cellulose acetate or polyester films. The surface of the substrate may be treated in order to improve the adhesion of the image-receiving layer to the support. For example, the surface may be corona discharge treated prior to applying the image-receiving layer to the support. Alternatively, an under-coating or subbing layer, such as a layer formed from a halogenated phenol or a partially hydrolyzed vinyl chloride-vinyl acetate copolymer, can be applied to the surface of the support.

The heterocyclic amine polymer used in the invention can be, for example, poly(1-vinylimidazole), poly(4-vinylpyridine), poly(2-vinylpyridine), poly(styrene-co-1-vinylimidazole-co-3-hydroxyethyl-1-vinylimidazolium chloride) (5:4:1 mole ratio), poly(styrene-co-1-vinylimidazole-co-3-benzyl-1-vinylimidazolium chloride) (5:4:1 mole ratio), poly(styrene-co-1-vinylimidazole-co-3-hydroxyethyl-1-vinylimidazolium chloride) (2:2:1 mole ratio), poly(styrene-co-4-vinylpyridine-co-1-hydroxyethyl-4-vinylpyridinium chloride) (5:4:1 mole ratio), poly(1-vinylimidazole-co-3-hydroxyethyl-1-vinylimadazolium chloride)(9:1mole ratio) and poly(acrylonitrile-co-4-vinyl- 1,2-methylenedioxybenzene-co-1-vinylimizazole-co-3-hydroxyethyl-1-vinylimadazolium chloride) (10:2:7:1 mole ratio). These heterocyclic amine polymers can serve as mordants that bind dyes and prevent wandering or smearing. The heterocyclic amine polymer may be coated at a level of from about 0.10 to 20.0 g/m$^2$, or more typically from about 0.20 to 10.0 g/m$^2$.

The water-soluble salts employed in this invention are comprised of the salts of metals of the first-row transition series of the periodic table of the elements, Sc, Ti, V, Cr, Mn, Fe, Co, Ni, Cu and Zn. Preferred first row transition metal ions include $Zn^{++}$, $Ni^{++}$, $Cu^{++}$, $Co^{++}$ and $Mn^{++}$. $Zn^{++}$ and $Mn^{++}$ are especially preferred where minimization of background color is important. Anions useful as components of the transition metal ion salts of this invention include chloride, sulfate, nitrate, acetate, phosphate and their hydrates, or any other anion that provides a water-soluble salt that does not interfere with the practice of this invention.

The metal ion salt employed in this invention is coated in the ink jet recording element at a level of from about 0.10 to 2.0 g/m$^2$, and preferably from about 0.20 to 1.0 g/m$^2$. On a molar basis the metal ion salt employed is coated in the ink jet recording element at a level of from about 0.0010 to 0.020 mole/m$^2$.

The ink jet coating may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

The image-receiving layer thickness may range from about 1 to about 60 $\mu$m, preferably from about 5 to about 40 $\mu$m.

The image-recording layer of the element used in the invention, can also contain a polymeric binder, e.g., a water soluble polymer such as poly(vinyl alcohol), gelatin, poly (vinyl pyrrolidone), poly(2-ethyl-2-oxazoline), poly(2-methyl-2-oxazoline), poly(acrylamide), Chitosan, methyl cellulose, ethyl cellulose, hydroxyethyl cellulose, hydroxypropyl cellulose, etc. Other binders can also be used such as low $T_g$ polymer latexes such as poly(styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate, a copolymer of vinylacetate and n-butylacrylate, etc.

Other additives may also be included in the image-recording layer such as pH-modifiers like nitric acid, cross-linkers, rheology modifiers, surfactants, UV-absorbers, biocides, lubricants, dyes, dye-fixing agents or mordants, optical brighteners etc.

After coating, the ink jet recording element may be subject to calendering or supercalendering to enhance surface smoothness. In a preferred embodiment of the invention, the ink jet recording element is subject to hot, soft-nip calendering at a temperature of about 65° C. and a pressure of 14000 kg/m at a speed of from about 0.15 m/s to about 0.3 m/s.

Ink jet inks used to image the recording elements employed in the present invention are well-known in the art. The receiving elements employed in this invention are particularly useful with inks comprising anionic dyes. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples further illustrate the invention.

EXAMPLES

Example 1

Improved Dye Light Stability

Control Element 1

Kodak Ektacolor Edge® F paper base, a pigmented, resin-coated paper support, was coated with an approximately 8 $\mu$m thick gelatin/polymer receiving layer consisting of 7.53 g/m$^2$ of type-IV bone gelatin, 1.08 g/m$^2$ of heterocyclic amine polymer, poly(1-vinylimidazole), 0.1 g/m$^2$ of spreading agent 10-G(Olin) and 0.026 g/m$^2$ of formaldehyde hardener. The receiving layer was coated from an aqueous solution at a 0.010 cm wet thickness and dried at about 50° C. Prior to coating, the solution pH was adjusted to about 7 by dropwise addition of 1N hydrochloric acid. The base gelatin/polymer layer was then overcoated with an aqueous solution of gelatin, providing a 1.08 g/m$^2$ gelatin overcoat.

Control Element 2

This element was prepared the same as Control Element 1 except that the aqueous gelatin overcoat solution also the contained a control salt, potassium chloride coated at a level of 0.00215 mole/m$^2$ (0.161 g/m$^2$).

Control Element 3

This element was prepared the same as Control Element 2 except that it contained magnesium sulfate heptahydrate.

Control Element 4

This element was prepared the same as Control Element 2 except that it contained calcium chloride dihydrate.

Control Element 5

This element Was prepared the same as Control Element 2 except that it contained calcium chloride dihydrate, coated at a level of 0.0043 mole/m$^2$.

Element 1 of the Invention

This element was prepared the same as Control Element 2 except that it contained a first row transition metal salt, zinc sulfate heptahydrate.

Element 2 of the Invention

This element was prepared the same as Control Element 2 except that it contained nickel(II) nitrate hexahydrate.

Element 3 of the Invention

This element was prepared the same as Control Element 2 except that it contained cobal(II) nitrate hexahydrate.

Element 4 of the Invention

This element was prepared the same as Control Element 2 except that it contained manganese(II) sulfate monohydrate.

Element 5 of the Invention

This element was prepared the same as Control Element 2 except that it contained ferrous sulfate heptahydrate.

Element 6 of the Invention

This element was prepared the same as Control Element 2 except that it contained cupric chloride, coated at a level of 0.00108 mole/m$^2$. The molar laydown of cupric chloride was reduced to half to lessen background color.

Element 7 of the Invention

This element was prepared the same as Control Element 2 except that it contained nickel nitrate hexahydrate and zinc sulfate heptahydrate, each coated at a level of 0.00108 mole/$m^2$.

Printing

Images were printed using a Hewlett Packard Desk Jet® 695C ink jet printer loaded with an ink cartridge containing Reactive Red 31 (Lyson magenta) aqueous soluble dye. The ink was prepared at a concentration to yield an optical transmission density of 1.0 in a 1 cm cell at 1000-fold dilution. The aqueous-based ink also contained 6.0 weight percent glycerol, 6.0 weight percent diethylene glycol and 0.5 weight percent Surfynol® 465. The ink was printed in steps to yield various reflection densities, including a density of approximately 1.0.

Light Stability

Reflection densities of the various printed samples were measured with an X-Rite® 338 densitometer. Samples were then exposed for one week to simulated daylight having an intensity of 50 Klux. Reflection densities were then remeasured, and the percentage losses in density were determined as follows:

TABLE I

| Element | % Loss in Green Density of Reactive Red 31 |
|---|---|
| Control 1 | 15 |
| Control 2 | 15 |
| Control 3 | 18 |
| Control 4 | 16 |
| Control 5 | 15 |
| 1 | 9 |
| 2 | 6 |
| 3 | 7 |
| 4 | 11 |
| 5 | 9 |
| 6 | 12 |
| 7 | 10 |

The results show that the recording elements employed in the invention provide substantial reductions in light-induced fade for the Reactive Red 31 magenta dye images.

Image Quality

In a test of resistance to high-humidity induced image smear, samples of resolution charts were also printed on the control elements and on the elements in the invention and then exposed for three days to 38° C./90% relative humidity. None of the elements of this invention showed significant image smearing in the high-humidity keeping test and maintained a resolution of at least 3 lines/mm. However, the control elements showed some smearing and loss of resolution on exposure to high humidity.

In addition, after soaking in distilled water for five minutes, the printed elements 1, 3, 4, 5 and 7 employed in the invention all showed less washout of Reactive Red 31 dye than Control Elements 1–5.

Example 2

Improved Dye Light Stability with Another Heterocyclic Amine Polymer.

Control Element 6

Kodak Ektacolor Edge® F paper base, a pigmented, resin-coated paper support, was coated with an approximately 8 $\mu$m thick gelatin/polymer receiving layer consisting of 7.53 g/$m^2$ of type IV bone gelatin, 1.08 g/$m^2$ of heterocyclic amine polymer, poly(4-vinylpyridine), 0.1 g/$m^2$ of spreading agent 10-G (Olin) and 0.026 g/$m^2$ of formaldehyde hardner. The receiving layer was coated at a 0.010 cm wet thickness from an aqueous solution adjusted to a pH of about 5 and dried at about 50° C. This base gelatin/polymer layer was then overcoated with an aqueous solution of gelatin, providing a 1.08 g/$m^2$ gelatin overcoat.

Control Element 7

This element was prepared the same as Control Element 6 except that it contained a control metal salt, magnesium sulfate heptahydrate, coated at a level of 0.00215 mole/$m^2$.

Control Element 8

This element was prepared the same as Control Element 7 except that it contained calcium chloride dihydrate.

Element 8 of the Invention

This element was prepared the same as Control Element 7 except that it contained a first-row transition metal salt nickel(II) nitrate hexahydrate.

Element 9 of the Invention

This element was prepared the same as Control Element 7 except that it contained manganese(II) sulfate monohydrate.

Printing

Images were printed as in Example 1.

Light Stability

Light stability measurements were carried out for Reactive Red 31 as in Example 1, and the results are given in the following Table II.

TABLE II

| Element | % Loss in Green Density of Reactive Red 31 |
|---|---|
| Control 6 | 11 |
| Control 7 | 11 |
| Control 8 | 11 |
| 8 | 7 |
| 9 | 8 |

The above results show that the elements employed in the invention had a reduced fade as compared to the control elements.

This invention has been described with particular reference to preferred embodiments thereof, but it will be understood that modifications can be made within the spirit and scope of the invention.

What is claimed is:

1. An ink jet printing method, comprising the steps of:

A) providing an ink jet printer that is responsive to digital data signals;

B) loading said printer with an ink jet recording element comprising a substrate having thereon an image-receiving layer comprising a heterocyclic amine polymer, said image-receiving layer having associated therewith a water-soluble first-row transition metal ion salt;

C) loading said printer with an ink jet ink composition; and

D) printing on said ink jet recording element using said ink jet ink in response to said digital data signals.

2. The method of claim 1 wherein said heterocyclic amine polymer is poly(1-vinylimidazole) or poly(4-vinylpyridine).

3. The method of claim 1 wherein said transition metal ion is $Zn^{++}$, $Ni^{++}$, $Cu^{++}$, $Co^{++}$ or $Mn^{++}$.

4. The method of claim 1 wherein said transition metal ion salt is present in an amount of from about 0.10 to 2.0 g/$m^2$.

5. The method of claim 1 wherein said transition metal ion salt is present in an amount of from about 0.0010 to 0.020 mole/$m^2$.

6. The method of claim 1 wherein heterocyclic amine polymer is present in an amount of from about 0.10 to 20.0 g/$m^2$.

7. The method of claim 1 wherein said ink jet ink composition comprises an anionic dye.

8. The method of claim 1 wherein said transition metal ion salt is located in said image-receiving layer.

9. The method of claim 1 wherein said transition metal ion salt is located in a layer over said image-receiving layer.

* * * * *